US008813383B2

(12) United States Patent
Liu et al.

(10) Patent No.: US 8,813,383 B2
(45) Date of Patent: Aug. 26, 2014

(54) WATERMARK-FREE HAND DRYER

(75) Inventors: Shen-Chen Liu, New Taipei (TW); Cing-Fong Jheng, New Taipei (TW)

(73) Assignee: Hokwang Industries Co., Ltd., New Taipei (TW)

( * ) Notice: Subject to any disclaimer, the term of this patent is extended or adjusted under 35 U.S.C. 154(b) by 270 days.

(21) Appl. No.: 13/413,044

(22) Filed: Mar. 6, 2012

(65) Prior Publication Data

US 2013/0232808 A1 Sep. 12, 2013

(51) Int. Cl.
*F26B 19/00* (2006.01)

(52) U.S. Cl.
USPC ..... 34/90; 34/95; 15/97.1; 392/380

(58) Field of Classification Search
USPC ..... 34/267, 90, 95, 96, 98, 100; 15/97.1; 132/735; 392/380, 384, 385
See application file for complete search history.

(56) References Cited

U.S. PATENT DOCUMENTS

| | | | | |
|---|---|---|---|---|
| 5,568,691 | A * | 10/1996 | Rubin | 34/98 |
| 6,038,786 | A * | 3/2000 | Aisenberg et al. | 34/267 |
| 6,189,230 | B1 * | 2/2001 | Huen | 34/90 |
| 7,614,160 | B2 * | 11/2009 | Kameishi et al. | 34/90 |
| 7,774,953 | B1 * | 8/2010 | Duran | 34/77 |
| 7,971,368 | B2 * | 7/2011 | Fukaya et al. | 34/77 |
| 8,201,344 | B2 * | 6/2012 | Sawabe et al. | 34/95 |
| 8,490,291 | B2 * | 7/2013 | Churchill et al. | 34/90 |
| 8,607,472 | B2 * | 12/2013 | Ishii et al. | 34/526 |
| 2008/0256825 | A1 * | 10/2008 | Hsu | 34/529 |

FOREIGN PATENT DOCUMENTS

| | | | | | |
|---|---|---|---|---|---|
| GB | 2428569 | A | * | 2/2007 | A47K 10/48 |
| JP | 9051861 | A | | 2/1997 | |
| JP | 10099234 | A | * | 4/1998 | A47K 10/48 |
| JP | 10099235 | A | * | 4/1998 | A47K 10/48 |
| JP | 11018999 | A | | 1/1999 | |
| JP | 2013013646 | A | * | 1/2013 | |
| TV | 579813 | U | | 3/2004 | |
| TW | 567822 | U | | 12/2003 | |
| TW | M357271 | U | | 5/2009 | |
| WO | WO 2007015040 | A1 | * | 2/2007 | A47K 10/48 |

* cited by examiner

*Primary Examiner* — Steve M Gravini
(74) *Attorney, Agent, or Firm* — Muncy, Geissler, Olds & Lowe, P.C.

(57) ABSTRACT

A watermark-free hand dryer includes a main body, an annular air discharge portion and a water absorbing portion. The main body generates high pressure airflow. The annular air discharge portion is connected to the main body and includes at least one extending section extended from the main body and a connecting section connected to the extending section. The extending section and connecting section surround to form an annular hand drying passage to receive user's hands. The annular air discharge portion further has at least one nozzle on an air discharge surface communicating with the annular air discharge portion. The nozzle forms an air discharge angle against the air discharge surface to output the high pressure airflow towards an air discharge side. The water absorbing portion is located on the main body and relative to the air discharge side to receive the high pressure airflow output from the nozzle.

8 Claims, 6 Drawing Sheets

WATERMARK-FREE HAND DRYER

FIELD OF THE INVENTION

The present invention relates to a hand dryer and particularly to a watermark-free hand dryer.

BACKGROUND OF THE INVENTION

With people's increasing demand for life quality, hygienic details become an important issue in their daily life, and this is especially notable on public lavatory facilities. In the past many public lavatory facilities must be operated manually by users. With development of infrared sensors, many manual public lavatory facilities were gradually replaced by untouched lavatory equipment. Now paper towels have been provided in many sites to enable users to dry hands after washing without dripping water everywhere. However, with increasing awareness of environmental protection and reservation, and growing consciousness of limited resources, using hand dryers to replace dispensable paper towel gradually becomes trendy.

Conventional hand dryers, such as R.O.C. patent Nos. M357271 and 579813, include an air outlet on the exterior thereof to eject air downwards to dry user's hands. The downward discharge air tends to blow drops of water from user's hands to the floor to become wet and slippery. Not only the environment looks untidy, it also creates hazardous concern to users.

R.O.C. patent No. 567822 also discloses a dryer with air discharge from two sides. Its hand dryer has multiple air outlets located at two sides of a hand drying zone to form bidirectional air discharge. Hand drying range is greater, and user's palm and back side of the hand can receive airflow simultaneously. It also has a water collection space between two walls to collect drops of water from user's hands into a water collection trough to facilitate water gathering and disposal. However, it requires regular handling of the water collection trough to empty the collected water. The water collection trough also tends to form watermarks after a prolonged period of time, or even becomes moldy or breeds bacteria. Hence it creates a troublesome sanitary issue.

To remedy the aforesaid problems, Japan publication Nos. JP9051861A and JP11018999A disclose a hand dryer equipped with a water absorbing means in the water collection trough. The water absorbing means (such as water absorbing disinfection sheet or sachet) can absorb a small amount of water collected by the hand dryer without breeding bacteria or forming watermarks in the water collection trough. However, the water absorbing means in the water collection trough has to be replaced regularly. It still cannot thoroughly resolve the water discharge problem of the hand dryer.

SUMMARY OF THE INVENTION

The primary object of the present invention is to provide a hand dryer that can clear and manage water drops during drying without a water collection trough To achieve the foregoing object, the invention provides a watermark-free hand dryer that includes a main body, an annular air discharge portion and a water absorbing portion. The main body aims to generate high pressure airflow. The annular air discharge portion is connected to the main body and includes at least one extending section extended from the main body and a connecting section connected to the extending section. The extending section and connecting section are joined and surround to form an annular hand drying passage to receive user's hands. The annular air discharge portion further has an air discharge surface relative to the annular hand drying passage, an air discharge side at one end of the annular hand drying passage and at least one nozzle located on the air discharge surface and communicating with the annular air discharge portion. The nozzle forms an air discharge angle against the air discharge surface to output the high pressure airflow towards the air discharge side. The water absorbing portion is located on the main body and relative to the air discharge side to receive the high pressure airflow output from the nozzle.

In one aspect the water absorbing portion is made of materials selected from the group consisting of water absorbing ceramics and porous materials.

In another aspect the annular air discharge portion is located vertically on the main body.

In yet another aspect the annular air discharge portion includes a water collecting section located on an upper edge of the main body and between the two extending sections to tilt towards the water absorbing portion.

In yet another aspect the main body is formed at a thickness greater than the annular air discharge portion.

In yet another aspect the water absorbing portion includes a water receiving surface indented downwards.

In yet another aspect the main body includes a channel connecting to the water absorbing portion to channel water drops on the water absorbing portion to drip.

In yet another aspect the main body includes a water collection tray communicating with the channel to receive the water drops therefrom.

In yet another aspect the annular air discharge portion includes an infrared sensor.

Thus, as the high pressure airflow generated by the annular air discharge portion can blow water drops on the user's hands to the water absorbing portion and also blow away moisture on the water absorbing portion at the same time, the hand dryer of the present invention is free of a water collection trough, thus can deal with the water problem efficiently. As a result, the problems of forming watermarks and breeding bacteria due to the water collection trough can be eliminated. The trouble of periodically clearing the water collection trough to empty the contaminated water in the water collection trough can also be averted.

The foregoing, as well as additional objects, features and advantages of the invention will be more readily apparent from the following detailed description, which proceeds with reference to the accompanying drawings.

DETAILED DESCRIPTION OF THE PREFERRED EMBODIMENTS

Figure 1:
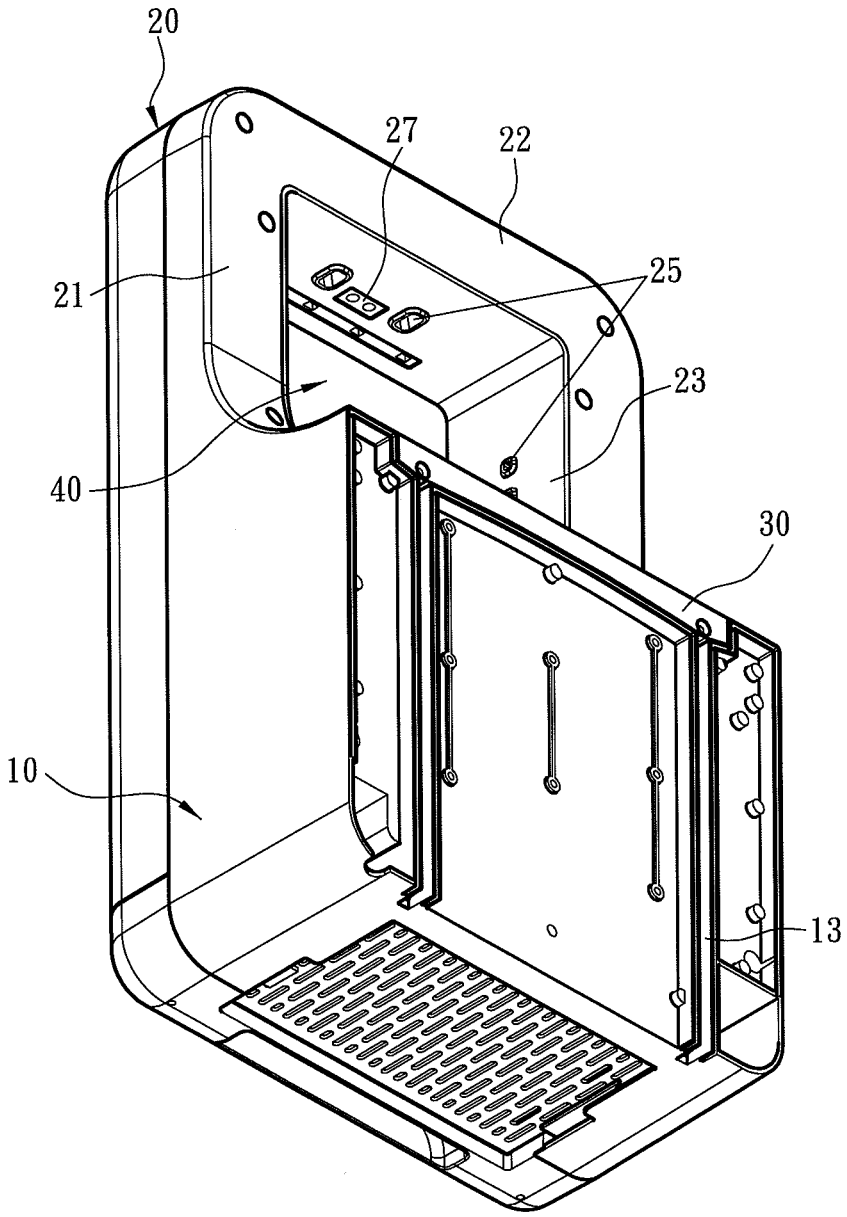
FIG. 1 is a perspective view of the watermark-free hand dryer of the invention.
Figure 2:
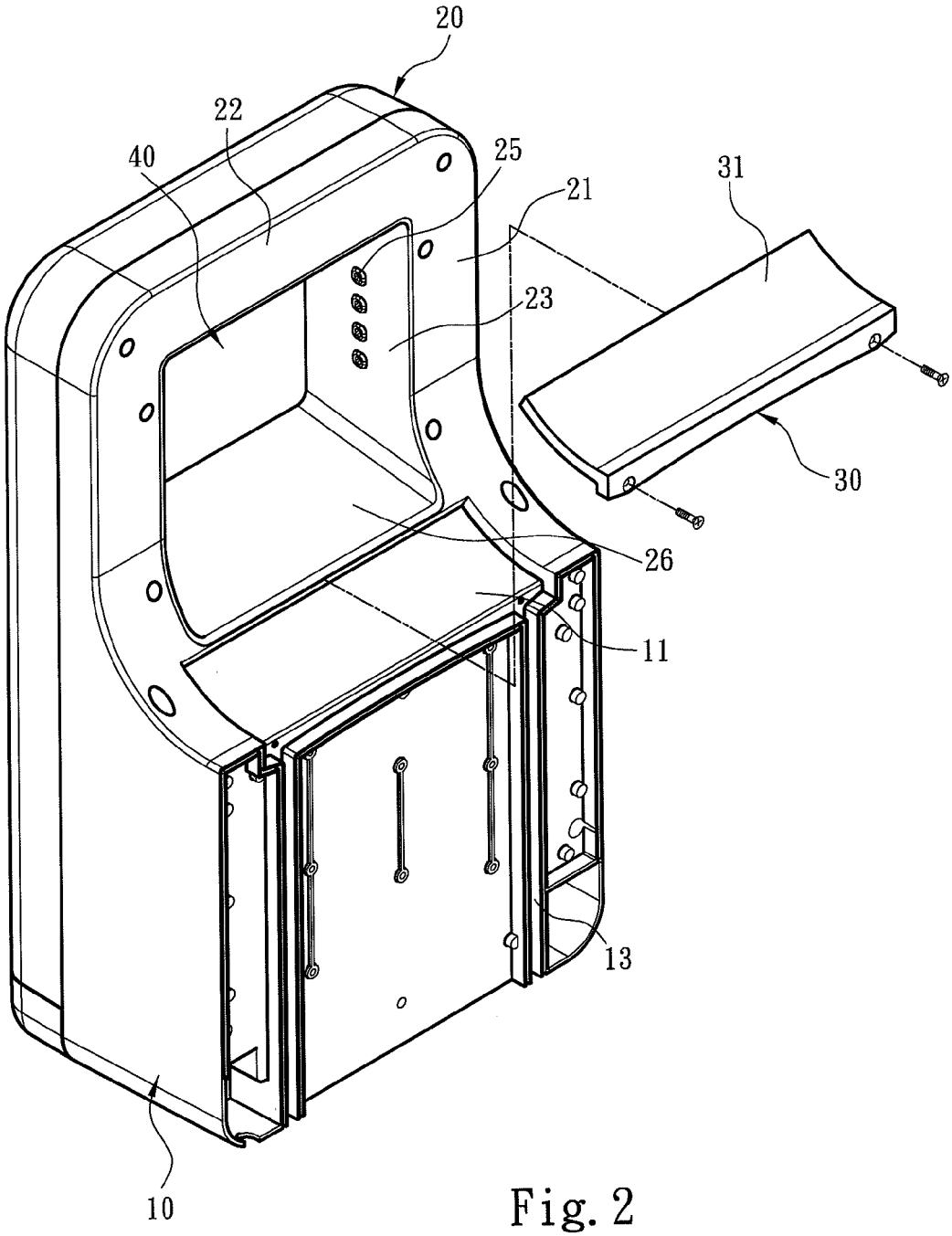
FIG. 2 is an exploded view of the hand dryer of the invention.
Figure 3:
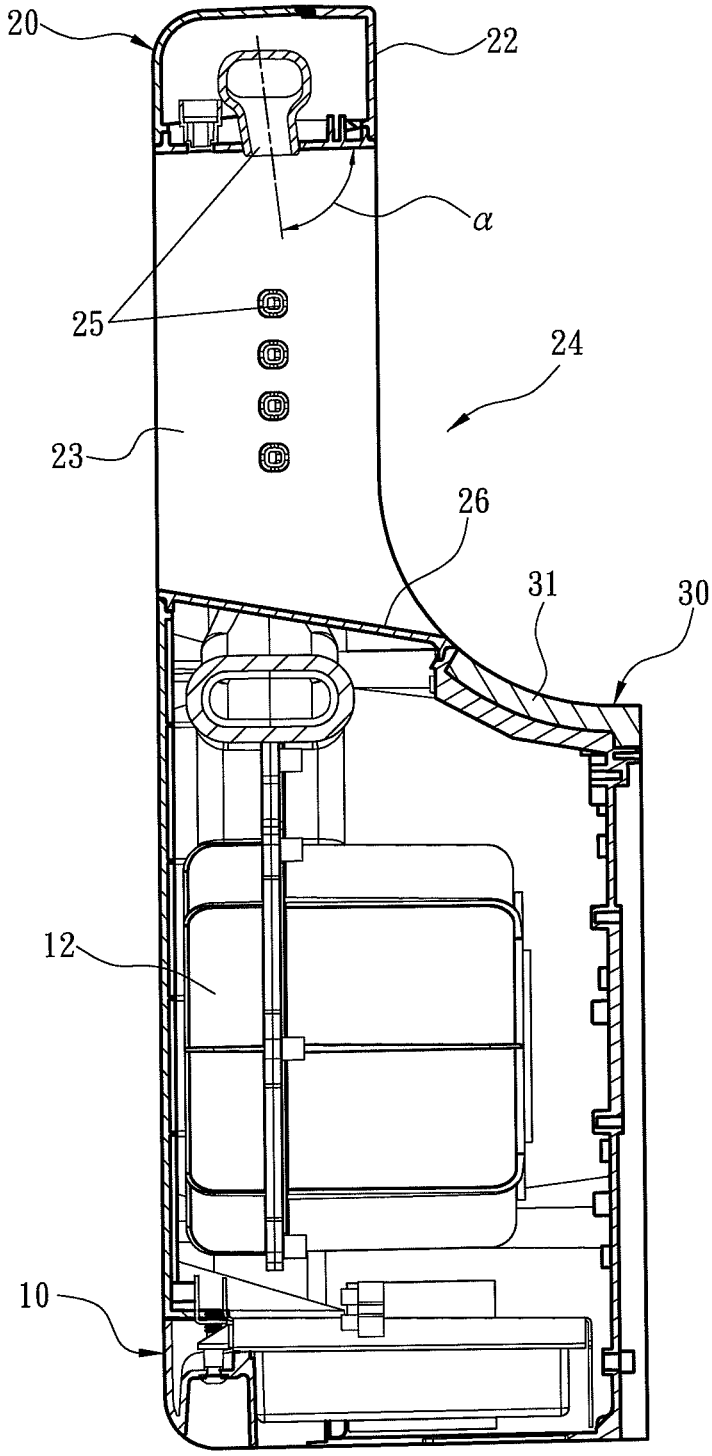
FIG. 3 is a sectional view of the hand dryer of the invention.

Please refer to FIGS. 1, 2 and 3, the present invention aims to provide a watermark-free hand dryer. The hand dryer mainly includes a main body 10, an annular air discharge portion 20 vertically located on the main body 10 and a water absorbing portion 30 located in the air discharge direction of the annular air discharge portion 20. The water absorbing portion 30 is made of water absorbing ceramics or other porous materials to achieve higher water absorbing efficiency and evaporation effect. The main body 10 can generate high pressure airflow to supply to the connected annular air discharge portion 20. The annular air discharge portion 20 has a plurality of nozzles 25 to blow water drops on user's hands to the water absorbing portion 30. Thus forms the main structure of the invention.

Structural details and technical features of the invention are elaborated below. The annular air discharge portion 20 includes at least one extending section 21 extended from the main body 10 and a connecting section 22 connected to the extending section 21. The extending section 21 and connecting section 22 are joined and surround to form an annular hand drying passage 40 to receive user's hands. The annular air discharge portion 20 further has an air discharge surface 23 relative to the annular hand drying passage 40, an air discharge side 24 at one end of the annular hand drying passage 40 and at least one nozzle 25 located on the air discharge surface 23 and communicating with the annular air discharge portion 20. The nozzle 25 forms an air discharge angle $\alpha$ against the air discharge surface 23 to output the high pressure airflow towards the air discharge side 24. The water absorbing portion 30 is located on the main body 10 and relative to the air discharge side 24 to receive the high pressure airflow output from the nozzle 25.

In order to install the water absorbing portion 30 relative to the air discharge side 24, the main body 10 is formed at a thickness greater than that of the annular air discharge portion 20 so that a zone to hold the water absorbing portion 30 is formed. The main body 10 further has a holding trough 11 corresponding to the air discharge side 24 to hold the water absorbing portion 30 by screwing. The annular air discharge portion 20 also has a water collecting section 26 located on an upper edge of the main body 10 and between the two extending sections 21 to tilt towards the water absorbing portion 30, so that when water drops drip into the water collecting section 26, they can flow along the water collecting section 26 to the water absorbing portion 30, thus the water absorbing portion 30 can absorb the water drops. Moreover, the annular air discharge portion 20 also has an infrared sensor 27 to detect insertion of the user's hands and activate the hand dryer.

Figure 4:
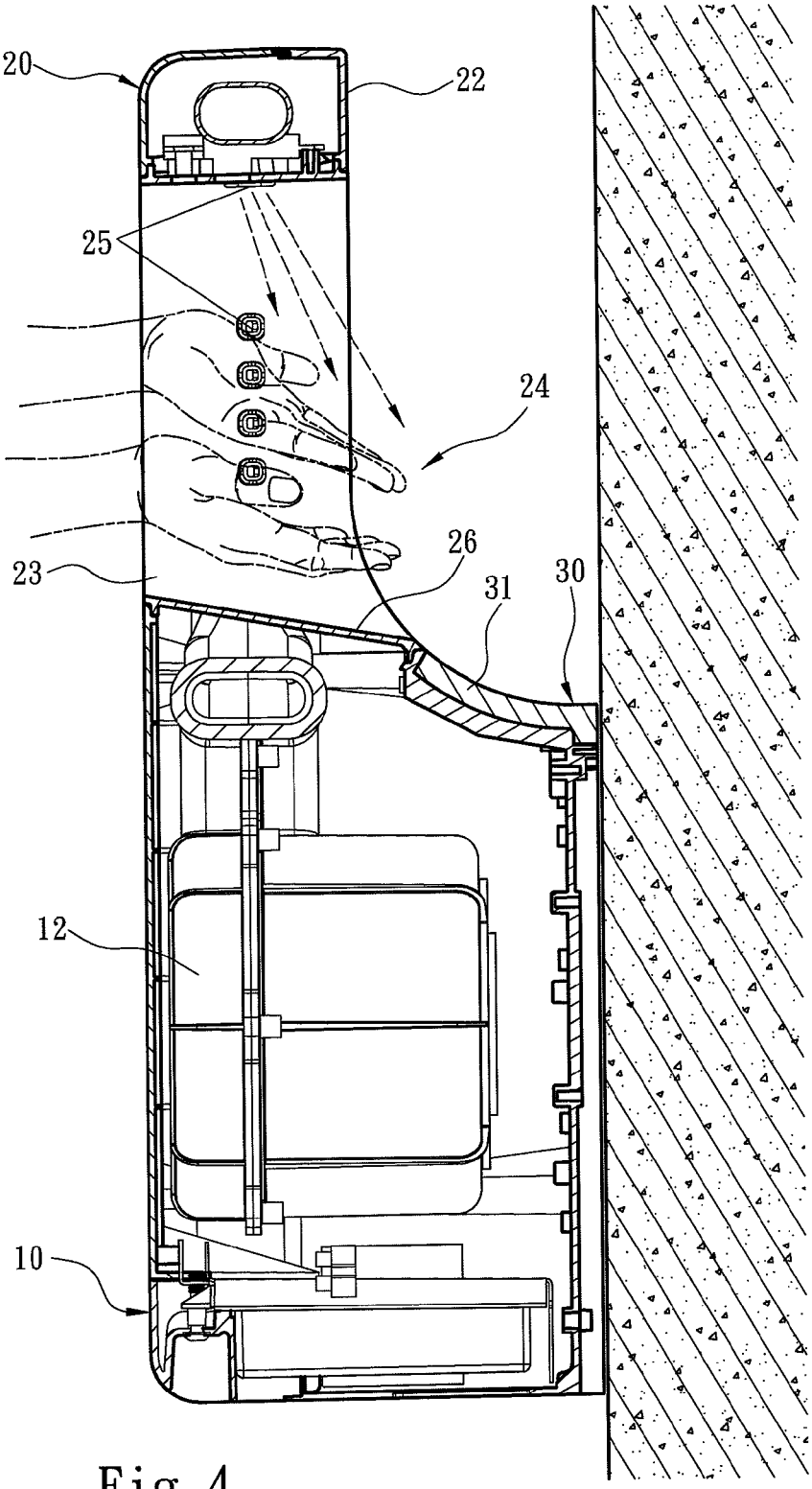
FIG. 4 is a schematic view of the invention in a use condition.

Please also refer to FIGS. 2 and 4, when the user's hands are inserted into the annular hand drying passage 40, the infrared sensor 27 (referring to FIG. 1) detects the user's hands and activates an air blower 12 on the main body 10 to generate high pressure airflow and supply the high pressure airflow to the nozzles 25 on the annular air discharge portion 20. The nozzles 25 are located on the two extending sections 21 at two sides of the annular hand drying passage 40 and connecting section 22 at the upper end of the annular hand drying passage 40 to form the air discharge angle $\alpha$ against the air discharge side 24. When the high pressure airflow flows to the nozzles 25, the nozzles 25 eject the high pressure airflow to form the converged airflow towards the air discharge side 24 so that the water drops on the user's hands are blown to the water absorbing portion 30 or the wall and then the water drops on the wall are dripped on the water absorbing portion 30. Moreover, as the converged airflow blows the water absorbing portion 30, the moisture on the water absorbing portion 30 is also evaporated at a high temperature.

Figure 5:
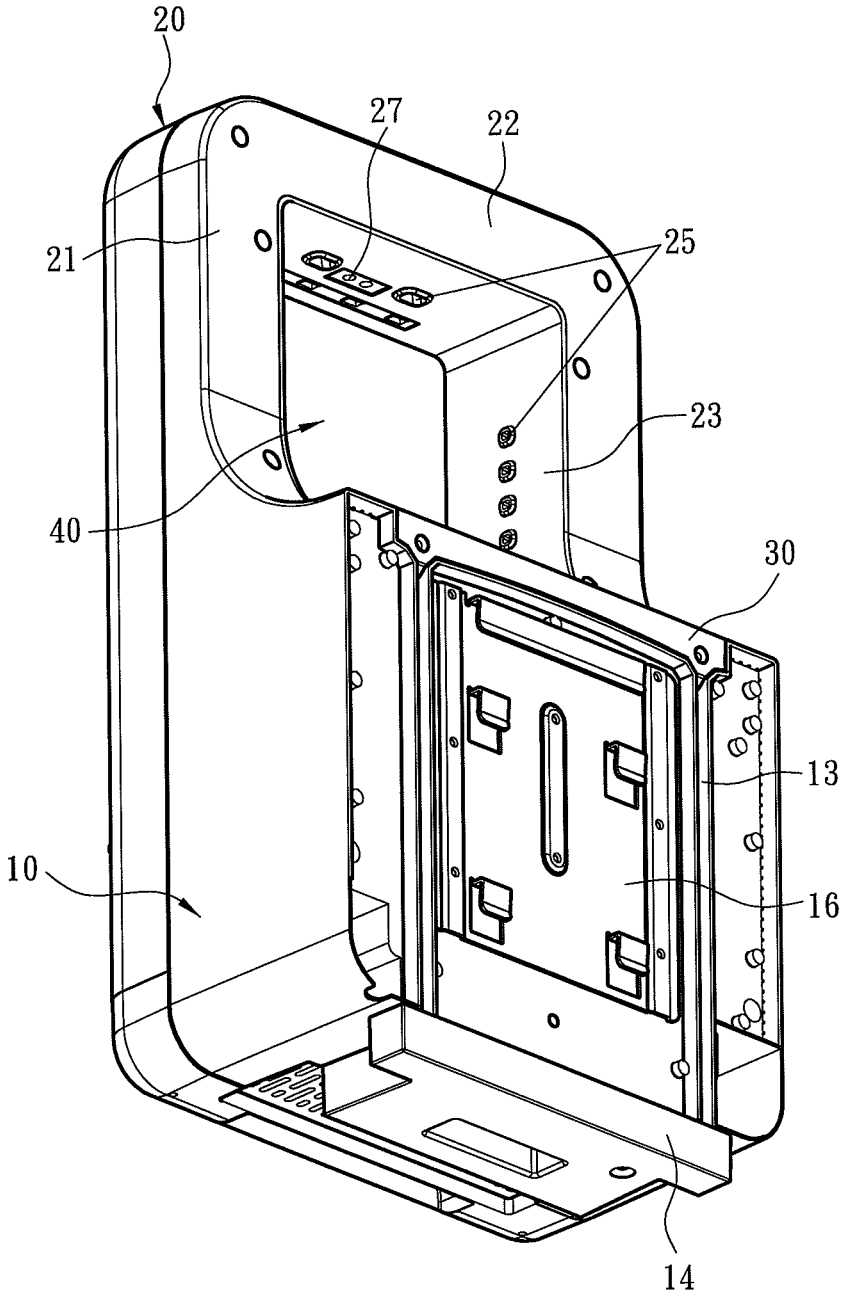
FIG. 5 is a perspective view of another embodiment of the invention.
Figure 6:
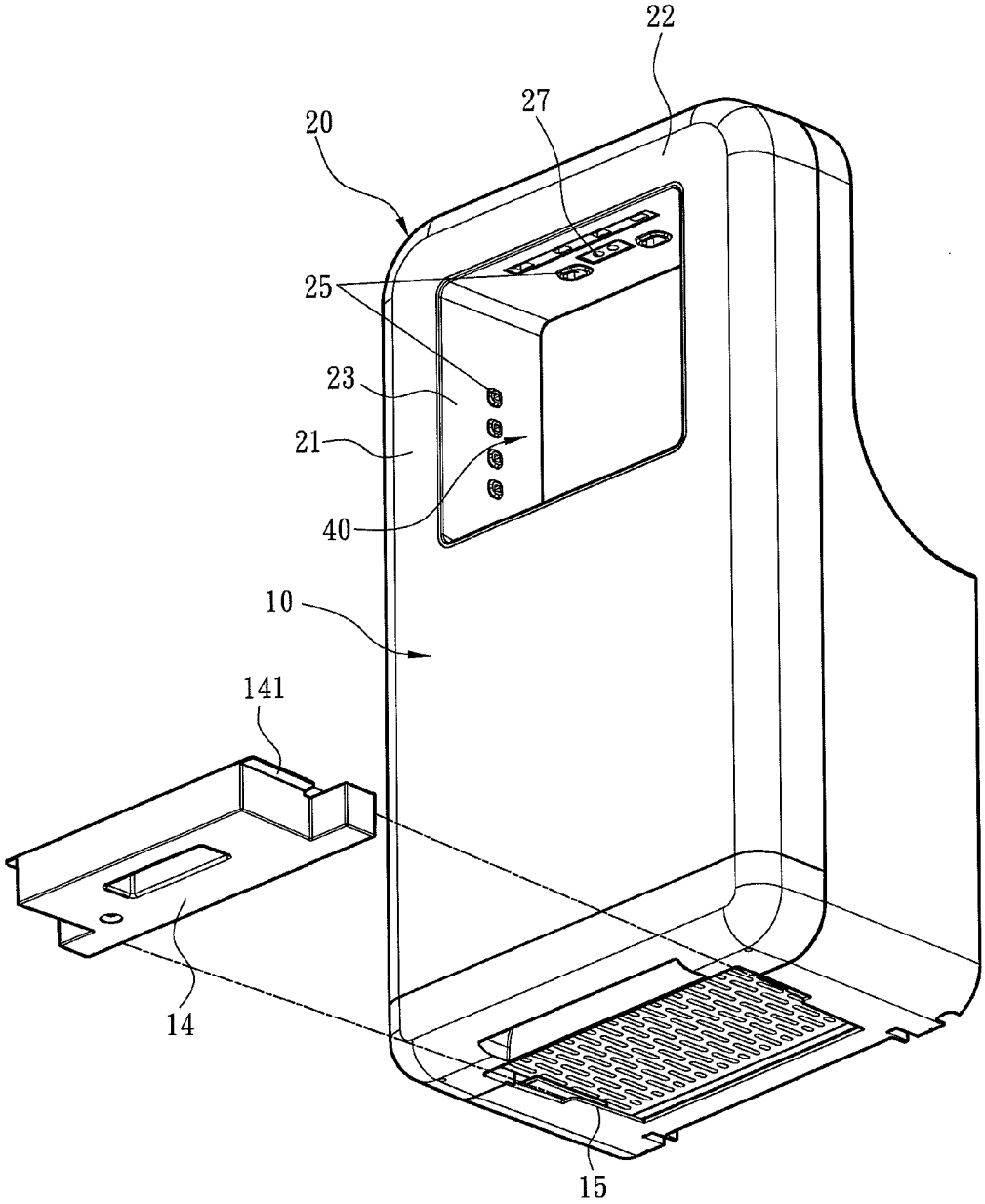
FIG. 6 is an exploded view of another embodiment of the invention.

Also refer to FIGS. 5 and 6 for another embodiment of the invention. The water absorbing portion 30 includes a water receiving surface 31 indented downwards (also referring to FIG. 4). When the water absorbing portion 30 is saturated, the water absorbed thereon flows downwards along a channel 13 located at a lower side thereof and collected by a water collection tray 14 below the channel 13, therefore the problem that water spilling outside to the floor when the water absorbing portion 30 is saturated can be prevented. The water collection tray 14 has a mounting portion 141, and the main body 10 has a mounting groove 15 at a lower end inserted by the mounting portion 141 so that when the water collection tray 14 is filled with water it can be removed from the lower end of the main body 10. The main body 10 further has a fastening panel 16 to allow the main body 10 to be securely fastened to a wall.

As a conclusion, as the high pressure airflow generated from the annular air discharge portion can blow water drops from user's hands to the water absorbing portion and also blow away the moisture on the water absorbing portion, the present invention is free of a water collection trough, hence can deal with water problem effectively and also solve the problems of watermarks and breeding of bacteria because of the water collection trough. In addition, there is no need to clear the water collection trough regularly or empty the contaminated water held in the water collection trough. The invention can be mounted onto a wall. When the water drops on the user's hands splash on the wall, the water drops can flow downwards to the water absorbing portion along the wall without spattering on the floor.

While the preferred embodiments of the invention have been set forth for the purpose of disclosure, they are not the limitations of the invention, modifications of the disclosed embodiments of the invention as well as other embodiments thereof may occur to those skilled in the art. Accordingly, the appended claims are intended to cover all embodiments which do not depart from the spirit and scope of the invention.

What is claimed is:

1. A watermark-free hand dryer, comprising:

a main body, whick is fastened to a wall and generates high pressure airflow;

an annular air discharge portion connecting to the main body to receive the high pressure airflow and including at least one extending section extended from the main body and a connecting section connecting to the extending section, an inner surface of the extending section and an inner surface of the connecting section being connected to form an annular hand drying passage to receive user's hands, the main body being formed at a thickness greater than that of the annular air discharge portion to form an air discharge side between the annular air discharge portion and the wall, the extending section and the connecting section respectively including at least one nozzle disposed on the inner surface thereof to output the high pressure airflow towards the air discharge side at an air discharge angle; and a water absorbing portion disposed on the main body and corresponding to the air discharge side to absorb and evaporate water drops introduced into the air discharge side by the high pressure airflow.

2. The watermark-free hand dryer of claim 1, wherein the water absorbing portion is made of materials selected from the group consisting of water absorbing ceramics and porous materials.

3. The watermark-free hand dryer of claim 1, wherein the annular air discharge portion is vertically located on the main body.

4. The watermark-free hand dryer of claim 1, wherein the annular air discharge portion includes a water collecting section located on an upper edge of the main body and between two extending sections to tilt towards the water absorbing portion.

5. The watermark-free hand dryer of claim 1, wherein the water absorbing portion includes a water receiving surface indented downwards.

6. The watermark-free hand dryer of claim 1, wherein the main body includes a channel connecting to the water absorbing portion to channel water drops on the water absorbing portion to drip.

7. The watermark-free hand dryer of claim 6, wherein the main body includes a water collection tray communicating with the channel to receive the water drops therefrom.

8. The watermark-free hand dryer of claim 1, wherein the annular air discharge portion includes an infrared sensor.

* * * * *